United States Patent [19]

Whiteman, Jr.

[11] Patent Number: 4,878,779

[45] Date of Patent: Nov. 7, 1989

[54] RIDING POWER TROWEL

[76] Inventor: Marvin E. Whiteman, Jr., 2254 Braniff St., Boise, Id. 83705

[21] Appl. No.: 306,089

[22] Filed: Feb. 3, 1989

[51] Int. Cl.[4] ..... E01C 19/22

[52] U.S. Cl. ..... 404/112; 401/85

[58] Field of Search ..... 404/112, 85, 83; 416/148, 121 R, 115, 102; 180/332; 51/177; 74/571 M, 571

[56] References Cited

U.S. PATENT DOCUMENTS 4,046,484 9/1977 Holz, Sr. et al. ..... 404/112

4,710,055 12/1987 Maass et al. ..... 404/112

*Primary Examiner*—Jerome W. Massie

*Assistant Examiner*—Gay Ann Spahn

*Attorney, Agent, or Firm*—Frank J. Dykas; Craig M. Korfanta

[57] ABSTRACT

A trim control 100 providing a weight distribution compensator to a riding power trowel 1. The trim control 100 has hollow cylindrical housing 101 rigidly attached to riding power trowel frame 3. Cylindrical housing 101 has traveler slot 102 disposed in its side parallel to the cylindrical housing's longitudinal axis. A cylindrical traveler block 110 is slidably inserted into cylindrical housing 101. Traveler block 110 has a threaded coaxial bore 111 disposed in a first end for receiving a threaded second end 105 of control bolt 103. A stop dog 112 is radially attached to cylindrical traveler block 110 through and extending radially outward from traveler slot 102. Thrust bearing 107 and shoulder bearing 108 are coaxially inserted and attached to a first end of hollow cylindrical housing 101. A radially disposed threaded through hole is provided in housing 101 and shoulder bearing 108 for receiving allen head set screw 109. Allen head set screw 109 is in threaded engagement with the through hole and penetrates the central opening in shoulder bearing 108. A scalloped control knob 104 is coaxially attached to a first end of control bolt 103. Control bolt 103 further has a coaxial set screw retaining groove 106 circumscribing its outer surface for slidably receiving allen head set screw 109.

1 Claim, 3 Drawing Sheets

RIDING POWER TROWEL

BACKGROUND OF THE INVENTION

1. Technical Field

This invention generally relates to riding cement surface working machines and in particular to a trim control for zeroing the control linkage to compensate for differing weight distributions experienced due to different riders.

2. Background Art

A typical two rotor riding surface working machine for finishing cement is taught by HOLZ, SR., ET AL., U.S. Pat. No. 4,046,484. Holz teaches a riding machine having two overlapping intermeshed rotors where the motion of the machine is controlled by a single control stick by a seated operator. Dual control sticks are also known and used in the art. For details on the locomotion and direction control of these machines, reference is made to U.S. Pat. No. 4,046,484, to HOLZ, SR., ET AL.

In general terms, the locomotion and direction of a riding surface working machine, also here referred to as a riding power trowel, is determined by circumferential pressure points of the two rotor assemblies against the working surface. Consequently, the operator must maintain a riding posture such that his center of gravity is coincident the center of gravity of the riding power trowel in order to prevent undesirable pressure points caused by an unbalanced rider and machine.

Unfortunately, riding power trowel operators come in various sizes and shapes and certainly each have various preferred postures. As it is impractical to custom design a riding power trowel to compensate for varying riders' weight and preferences, manufacturers have heretofore left it up to the operator to compensate his posture accordingly. This presents a significant problem to persons while learning to operate a riding power trowel and can be very uncomfortable to the experienced user. If not compensated for, an unbalanced machine will demonstrate sluggish and possibly erratic performance.

What is needed is a device capable of compensating for the differing weight distributions demonstrated by different operators.

Accordingly, it is an object of the present invention to provide a trim control to a riding power trowel thereby giving the operator the ability to adjust the balance of the machine to compensate for his particular weight distribution. It is a further object of the present invention to provide a trim control which can be adjusted by the operator while the machine is in operation.

DISCLOSURE OF INVENTION

In order to better disclose the invention it is necessary to define some common nomenclature as it applies here. The longitudinal axis will hereinafter refer to a line parallel to the working surface and intersecting the rotor hub axes. The transverse axes will hereinafter refer to two parallel lines, each of which is perpendicular to the longitudinal axis and parallel to the working surface and further, each intersecting a rotor hub axis. The longitudinal and transverse axes are fixed in the rotor reference frame and will therefore be angularly displaced with respect to the working surface as a result of unbalanced weight distributions. The general intent of the present invention is to adjustably bias the control linkage such that the longitudinal and transverse axes are in fact parallel to the working surface.

The present disclosure assumes that most operators will be of symmetric physique, i.e. the right half of the body is essentially a mirror image of the left half. It further assumes that the operators will sit in the longitudinal center of the rider seat. Consequently, no trim control is provided to the longitudinal axis. However, to provide a trim control to the longitudinal axis is well within the scope of the present invention.

All the previously mentioned objects and objectives, along with others, are accomplished by a trim control having a hollow cylindrical housing, a cylindrical traveler block, a retaining bearing, a stop dog, and a tensive spring.

A hollow cylindrical housing is rigidly attached to the frame of the riding power trowel. The cylindrical housing further has a traveler slot disposed in its side parallel to the cylindrical housing's longitudinal axis. A cylindrical traveler block is slidably inserted into the cylindrical housing. The traveler block has a threaded coaxial bore disposed in its first end for receiving the control bolt. Additionally, the traveler block has a stop dog radially attached thereto which extends through the traveler slot.

A retaining bearing is coaxially inserted and attached into the first end of the hollow cylindrical housing. A radially disposed threaded through hole is provided in the housing and the retaining bearing. An allen head set screw, or the like, is in threaded engagement with the through hole and penetrates the opening in the retaining bearing.

A control bolt has a scalloped knob attached to its first end and a threaded second end. The control bolt has a coaxial groove circumscribing its outer surface disposed approximately one-third of the total length down shank of the bolt for slidable engagement with the set screw. The second end of the control bolt is threadedly engaged with the coaxial bore in the traveler block. As the control bolt is turned within the cylindrical housing the traveler block travels up or down the housing within the limits of the stop dog and traveler slot.

The tensive spring has a first end attached to the second end of the traveler block and a second end attached to the control linkage which controls the angular displacement of the transverse axes.

In use the operator has simply to turn the scalloped control knob one way or the other to properly bias the transverse axes, thereby compensating for any imbalance due to improper weight distribution. This adjustment can be accomplished by the operator while the power trowel is in use.

BEST MODE FOR CARRYING OUT INVENTION

Figure 1:
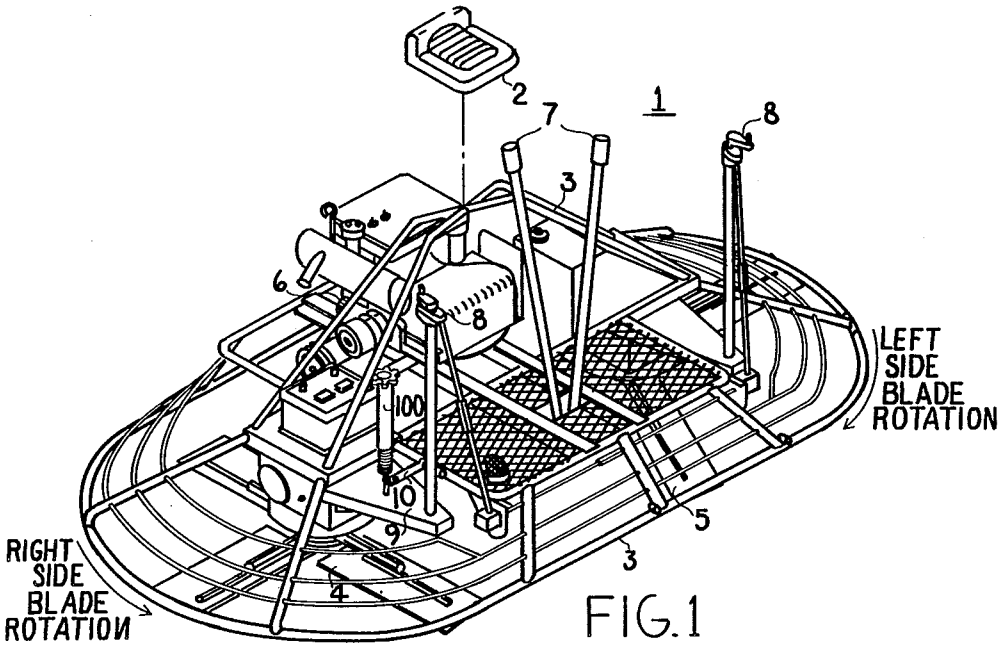
FIG. 1 is an elevation representation of a riding power trowel having a trim control installed thereon.

While this particular embodiment refers specifically to the machine shown in FIG. 1, it should be understood that invention applies equally to the machine taught by HOLZ, SR., ET AL., U.S. Pat. No. 4,046,484 which is incorporated by reference herein. FIG. 1 shows a dual control stick riding power trowel 1 having trim control 100 installed thereon.

Riding power trowel 1 generally has rider seat 2 supported directly above the center of gravity by frame 3. Right rotor 4 and left rotor 5 are pivotally suspended from frame 3 and are connected together via linkage assemblies, including transverse axes control linkage 10. Engine 6 is also supported by frame 3 and serves as a rotation means for right and left rotors 4 and 5. Dual control sticks 7 are provided to activate the various control linkages. Blade pitch controls 8 are provided and can operate in tandem or independent of one another. Right gear box adapter plate 9 is attached to right rotor assembly 4 and imparts angular displacements to the transverse axes from the transverse axes control linkage 10.

Figure 2:
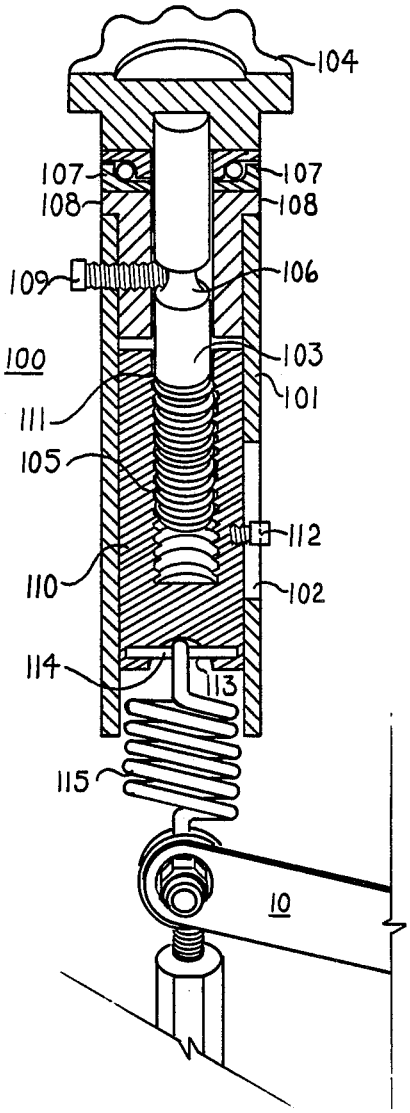
FIG. 2 is a partial sectional side view of the trim control.
Figure 3:
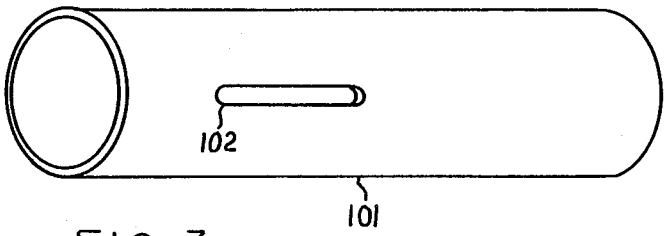
FIG. 3 is an elevation view of the hollow cylindrical housing and traveler slot.

Referring also now to FIGS. 2 and 3, trim control 100 is shown in greater detail. Trim control 100 has hollow cylindrical housing 101 rigidly attached to frame 3. Cylindrical housing 101 has traveler slot 102 disposed in its side parallel to the cylindrical housing's longitudinal axis. A cylindrical traveler block 110 is slidably inserted into cylindrical housing 101. Traveler block 110 has a threaded coaxial bore 111 disposed in its first end for receiving the threaded second end 105 of control bolt 103. A stop dog 112 is radially attached to cylindrical traveler block 110 through and extending radially out from traveler slot 102.

A retaining bearing, here consisting of thrust bearing 107 and shoulder bearing 108 is coaxially inserted and attached into a first end of hollow cylindrical housing 101. A radially disposed threaded through hole is provided in housing 101 and shoulder bearing 108. Allen head set screw 109 is in threaded engagement with the through hole and penetrates the central opening in shoulder bearing 108.

A control bolt 103 has a scalloped control knob 104 coaxially attached to its first end and further, a threaded second end 105. Control bolt 103 has a coaxial set screw retaining groove 106 circumscribing its outer surface disposed approximately one-third of the total length down shank for slidable engagement with set screw 109. Threaded second end 105 of control bolt 103 is threadedly engaged with coaxial bore 111. As control bolt 103 is turned within cylindrical housing 101, traveler block 110 travels up or down housing 101, within the limits of travel as determined by stop dog 112 and traveler slot 102.

A spring slot 113 is provided in the second end of cylindrical traveler block 110 and has a roller pin 114 diametrically attached thereto.

A tensive spring 115 is provided and has its first end attached to roller pin 114 and a second end attached to control linkage 10 which controls the angular displacement of the transverse axes.

In use, the operator has simply to turn scalloped control knob 104 one way or the other to properly bias the transverse axes, thereby compensating for any imbalance due to improper weight distribution. Of particular significance is the fact that the operator can make these trimming adjustments while the power trowel is in use. For example, a new cement floor can be poured, the power trowel placed atop the wet cement with operator seated, the power trowel started and initial trowelling operation is commenced. If the operator then discovers that the trim is not correct, he need not return to the starting point and dismount from the power trowel in order to make necessary adjustments. Instead all he has to do is twist control knob 104 one way or the other to properly bias the transverse axes.

While there is shown and described the present preferred embodiment of the invention, it is to be distinctly understood that this invention is not limited thereto but may be variously embodied to practice within the scope of the following claims.

I claim:

1. In a riding surface working machine having a pair of overlapping counter rotating rotor assemblies and a control linkage there between, a trim control which comprises:

a hollow cylindrical housing being rigidly attached to a stationary point on the riding surface working machine and having a traveler slot disposed in one side being parallel to the housing's longitudinal axis;

a cylindrical traveler block being slidably inserted into said cylindrical housing and having a coaxial threaded bore in a first end;

a shoulder bearing coaxially installed in a first end of said cylindrical housing having a radially disposed threaded through hole and an allen screw engaged therewith;

a control bolt having a scalloped knob coaxially attached to a first end and a threaded second end sized for and being in threaded engagement with the threaded bore of said first end of said traveler block, said control bolt further having a coaxial groove circumscribing its outer surface and disposed for slidable engagement with said allen screw;

a stop dog being radially attached to said traveler block and extending radially through the traveler slot in said cylindrical housing; and a tensive spring having a first end attached to a second end of said traveler block and a second end attached to the control linkage.

* * * * *